US005706666A

United States Patent [19]

Yamanaka et al.

[11] Patent Number: 5,706,666

[45] Date of Patent: Jan. 13, 1998

[54] REFRIGERATION APPARATUS

[75] Inventors: Yasushi Yamanaka, Nakashima-gun; Nobuharu Kakehashi; Hiroshi Kishita, both of Anjo; Kenichi Fujiwara, Kariya, all of Japan

[73] Assignee: Nippondenso Co., Ltd., Kariya, Japan

[21] Appl. No.: 796,861

[22] Filed: Feb. 6, 1997

Related U.S. Application Data

[62] Division of Ser. No. 420,490, Apr. 12, 1995, Pat. No. 5,619,861.

[30] Foreign Application Priority Data

Apr. 12, 1994 [JP] Japan ..... 6-73325
Sep. 22, 1994 [JP] Japan ..... 6-228112

[51] Int. Cl.[6] ..... F25B 41/04

[52] U.S. Cl. ..... 62/225; 62/512; 236/92 B

[58] Field of Search ..... 62/225, 512; 236/92 B

[56] References Cited

U.S. PATENT DOCUMENTS 3,738,573 6/1973 Eschbaugh et al. ..... 236/92 B
4,341,086 7/1982 Ishii ..... 62/225
4,370,868 2/1983 Kim et al. ..... 62/504
4,972,676 11/1990 Sakai ..... 62/512
5,056,329 10/1991 Wilkinson ..... 62/512

FOREIGN PATENT DOCUMENTS 2650935 5/1978 Germany .
5-18635 1/1993 Japan .
5-79725 3/1993 Japan .

*Primary Examiner*—William E. Tapolcai
*Attorney, Agent, or Firm*—Cushman, Darby & Cushman IP Group of Pillsbury Madison & Sutro LLP

[57] ABSTRACT

A centrifugal type separator is disposed on a downstream side of a temperature-operating type expansion valve. Liquid-phase refrigerant separated herein is again pressure-reduced by an aperture resistance and thereafter inducted to an inlet side of the evaporator by means of a liquid-phase refrigerant discharge passage. Meanwhile, gas-phase refrigerant separated by the separator is returned directly from a gas-phase refrigerant discharge passage to an evaporator outlet side passage, and after being united with superheated gas-phase refrigerant evaporated by the evaporator, is taken into a compressor. A temperature-sensing tube of the expansion valve is disposed further on the downstream side of the foregoing union location so as to enable the temperature of the superheated gas-phase refrigerant evaporated by the evaporator to be sensed accurately.

6 Claims, 14 Drawing Sheets

ON-OFF CONTROL CYCLE

EPR CYCLE

REFRIGERATION APPARATUS

This is a division of application Ser. No. 08/420,490, filed Apr. 12, 1995, now U.S. Pat. No. 5,619,861.

CROSS REFERENCE TO RELATED APPLICATIONS

This application is based upon and claims priority from Japanese Patent Application No. Hei 6-73325 filed Apr. 12, 1994 and Japanese Patent Application No. Hei 6-228112 filed Sep. 22, 1994, with the contents of each document being incorporated herein by reference.

BACKGROUND OF THE INVENTION

1. Field of the Invention

The present invention relates generally to a modification of a refrigeration apparatus, for example suitable for employment in an air-conditioning device for automotive use, and more particularly, to a modification of an evaporator in a refrigeration apparatus for the purpose of performance enhancement.

2. Description of the Related Art

An example provided in Japanese Patent Application Laid-open No. Hei 5-18635 exists as a prior example intended to enhance evaporator performance in a refrigeration apparatus of this type. This prior art disposes a gas-liquid separation chamber to separate gas-phase and liquid-phase refrigerant on a core portion side end portion of a laminate type evaporator composed by laminating flat tubing and corrugated fins, providing in this gas-liquid separation chamber an inlet chamber to which a refrigerant inlet pipe is connected and an outlet chamber to which a refrigerant outlet pipe is connected, disposing an inlet side tank portion communicated with an inlet tank of the core portion on a bottom portion of the inlet chamber, disposing an outlet side tank portion communicated with an outlet tank of the core portion on a bottom portion of the outlet chamber, and further structured to cause the inlet chamber and the outlet chamber to be communicated by a bypass passage portion at an uppermost portion thereof.

By means of this, refrigerant of which the pressure has been reduced by a pressure-reducing means of an expansion valve or the like to assume a gas-liquid two-phase state is separated in a vertical direction by means of specific gravity differential in the gas-liquid separation chamber; liquid-phase refrigerant with high specific gravity is caused to flow from the inlet chamber bottom portion through the inlet side tank portion and into an inlet tank of the core portion, such that the liquid-phase refrigerant is distributed uniformly of this inlet tank to multiple flat tubing. Meanwhile, in the inlet chamber of the gas-liquid separation chamber, gas-phase refrigerant with low specific gravity shifts to the upper side, and passes through the bypass passage portion of the uppermost portion to flow directly into (bypass) the outlet chamber. Accordingly, gas-phase refrigerant which has exchanged heat with blown air for air-conditioning use or the like and evaporated in the flat tubing passes through the core portion outlet tank and flows into the outlet chamber. Consequently, gas-phase refrigerant which has evaporated in the core portion and gas-phase refrigerant which has bypassed from the gas-liquid separation chamber is mixed in this outlet chamber, is discharged externally from the outlet pipe, and is taken into the compressor.

As an incidental comment, according to the foregoing conventional device, if gas-phase refrigerant can be separated sufficiently in the gas-liquid separation chamber, this separated gas-phase refrigerant can be distributed uniformly to the respective tubing of the core portion, and so effective utilization for the purpose of heat exchange with the entirety of the core portion without generating excessive or insufficient refrigerant among the multiple tubing is possible.

However, specific experimentation and investigation by the inventors with regard to the foregoing conventional device revealed the occurrence of the problems that will be described hereinafter.

To wit, firstly, because gas-phase refrigerant which has been separated in the gas-liquid separation chamber utilizing the specific gravity differential of gas-phase and liquid-phase refrigerant is caused to flow into the core portion inlet tank without change, at times such as during a summer period when the cooling load is large, in a case of R134a refrigerant, high pressure (i.e., pressure of the high-pressure circuit from the compressor discharge side to the pressure-reducing means inlet side of the refrigeration apparatus) assumes a high pressure of about 15 $kg/cm^2$, and as a result thereof refrigerant downstream of the pressure-reducing means (evaporator inlet) is subsequent to pressure reduction, and so the degree of dryness thereof becomes large, a large quantity of gas is generated, and the proportion of gas-phase refrigerant in terms of the weight ratio reaches 40%. For this reason, gas-phase and liquid-phase refrigerant cannot be separated sufficiently in the gas-liquid separation chamber, and refrigerant flows into the core portion in a state wherein gas-phase refrigerant is intermixed with the liquid-phase refrigerant. It was discovered that, by means of this, the distribution of liquid-phase refrigerant to the respective tubing in the core portion becomes nonuniform, leading to a drop in evaporator performance.

Secondly, in a case where a temperature-operating type expansion valve is used as a pressure-reducing means, a temperature-sensing tube is disposed on a downstream side of the refrigerant outlet pipe of the evaporator, and so the temperature of refrigerant in which is mixed superheated gas-phase refrigerant evaporated in the core portion and saturated gas-phase refrigerant bypassed from the foregoing gas-liquid separation chamber is necessarily detected. As a result of this, a temperature lower than the actual temperature of the superheated gas-phase refrigerant of the evaporator outlet by an amount corresponding to the saturated gas-phase refrigerant comes to be detected, and the problem occurs wherein the expansion valve cannot optimally regulate refrigerant flow to the evaporator. Actually, it was discovered that the expansion valve tends to close, leading to the problem of a drop in evaporator capacity.

Furthermore, when cooling load is small and the degree of dryness of refrigerant downstream of the expansion valve is small, liquid-phase refrigerant comes to be intermixed with gas-phase refrigerant separated in the gas-liquid separation chamber and bypassed, and so the detected temperature of the temperature-sensing tube drops further, and as a result thereof the above-described problem becomes more marked.

SUMMARY OF THE INVENTION

In view of the above-described points, it is an object of the present invention to provide a refrigeration apparatus which can enhance uniformity of refrigerant distribution to respective tubing of an evaporator even in a state of large cooling load.

Additionally, it is another object of the present invention to provide a refrigeration apparatus disposing a refrigerant gas-liquid separation means on a downstream side of a temperature-operating type expansion valve, wherein a temperature-sensing means (temperature-sensing tube or the like) of an expansion valve can accurately sense temperature of superheated gas-phase refrigerant of an evaporator outlet, and which can optimally control refrigerant flow to the evaporator.

In order to attain the foregoing objects, the present invention employs technical means that will be described hereinafter.

A preferred mode of refrigerant apparatus in the invention includes a compressor to compress and discharge refrigerant, a condenser to cool and condense high-temperature, high-pressure gas-phase refrigerant discharged from this compressor, a pressure-reducing means to reduce pressure of liquid-phase refrigerant condensed by this condenser, a gas-liquid separation means to separate gas-liquid two-phase refrigerant pressure-reduced by this pressure-reducing means into liquid-phase refrigerant and gas-phase refrigerant, a liquid-phase refrigerant discharge passage to discharge liquid-phase refrigerant separated by this gas-liquid separation means from the gas-liquid separation means, a gas-phase refrigerant discharge passage to discharge gas-phase refrigerant separated by this gas-liquid separation means from the gas-liquid separation means, an auxiliary pressure-reducing means provided in this liquid-phase refrigerant discharge passage to again reduce pressure of refrigerant, an evaporator connected to a downstream side passage of this auxiliary pressure-reducing means so that refrigerant again pressure-reduced by this auxiliary pressure-reducing means flows in, to evaporate this inflowing refrigerant, and an evaporator outlet side passage to cause gas-phase refrigerant from this gas-phase refrigerant discharge passage to unite with gas-phase refrigerant evaporated by this evaporator and to be caused to be taken in on an intake side of the compressor.

One of other preferred mode of the refrigerant apparatus includes a compressor to compress and discharge refrigerant, a condenser to cool and condense high-temperature, high-pressure gas-phase refrigerant discharged from this compressor, a temperature-operating type expansion valve having a restricting passage to reduce pressure of liquid-phase refrigerant condensed by this condenser and a valve to regulate a degree of opening of this restricting passage, a gas-liquid separation means to separate gas-liquid two-phase refrigerant pressure-reduced by this temperature-operating type expansion valve into liquid-phase refrigerant and gas-phase refrigerant, a liquid-phase refrigerant discharge passage to discharge liquid-phase refrigerant separated by this gas-liquid separation means from the gas-liquid separation means, a gas-phase refrigerant discharge passage to cause to discharge gas-phase refrigerant separated by the gas-liquid separation means from the gas-liquid separation means, an evaporator connected to a downstream side passage of this liquid-phase refrigerant discharge passage so that refrigerant flows in from the liquid-phase refrigerant discharge passage, to evaporate this inflowing refrigerant, and an evaporator outlet side passage to cause gas-phase refrigerant from the gas-phase refrigerant discharge passage to unite with gas-phase refrigerant evaporated by this evaporator and to be caused to be taken in on an intake side of the compressor wherein the temperature-operating type expansion valve further comprises temperature-sensing means disposed in locations in the evaporator outlet side passage which are upstream of a union location of gas-phase refrigerant evaporated by the evaporator and gas-phase refrigerant from the gas-phase refrigerant discharge passage, to sense temperature of gas-phase refrigerant evaporated by the evaporator, and needle valve operating means to regulate a degree of opening of the needle valve in correspondence to the gas-phase refrigerant temperature sensed by these temperature-sensing means.

In an invention according to the preferred mode, after gas-liquid two-phase refrigerant pressure-reduced by the pressure-reducing means is separated into gas and liquid by the gas-liquid separation means, the refrigerant is again pressure-reduced by the auxiliary pressure-reducing means provided in the liquid-phase refrigerant discharge passage, and so the proportion of refrigerant flow discharged from the gas-liquid separation means to the liquid-phase refrigerant discharge passage side and of the refrigerant flow discharged from the gas-liquid separation means to the gas-phase refrigerant discharge passage side connected established so as to become exactly the proportion of gas and liquid by means of the auxiliary pressure-reducing means. As a result of this, even during high load wherein high pressure becomes high, gas-phase refrigerant flowing into the evaporator is made insignificant, uniformity of refrigerant distributed to the respective tubing in the evaporator can be improved, and evaporator performance can be effectively improved.

In an invention according to other preferred mode, when providing the gas-liquid separation means on the downstream side of the temperature-operating type expansion valve, the installation location of the temperature-sensing means of the foregoing temperature-operating type expansion valve is established at a location in the foregoing evaporator discharge side passage which is upstream of the union location of gas-phase refrigerant evaporated by the foregoing evaporator and gas-phase refrigerant from the foregoing gas-phase refrigerant discharge passage, and so superheated gas-phase refrigerant temperature from the evaporator can be sensed accurately by means of the temperature-sensing means without the saturated gas-phase refrigerant temperature from the gas-phase refrigerant discharge passage being affected, and consequently the refrigerant flow control effect of the expansion valve can be favorably maintained.

DETAILED DESCRIPTION OF THE PREFERRED EMBODIMENTS

Embodiments according to the present invention will be described hereinafter with reference to the drawings.

(First Embodiment)

Figure 1:
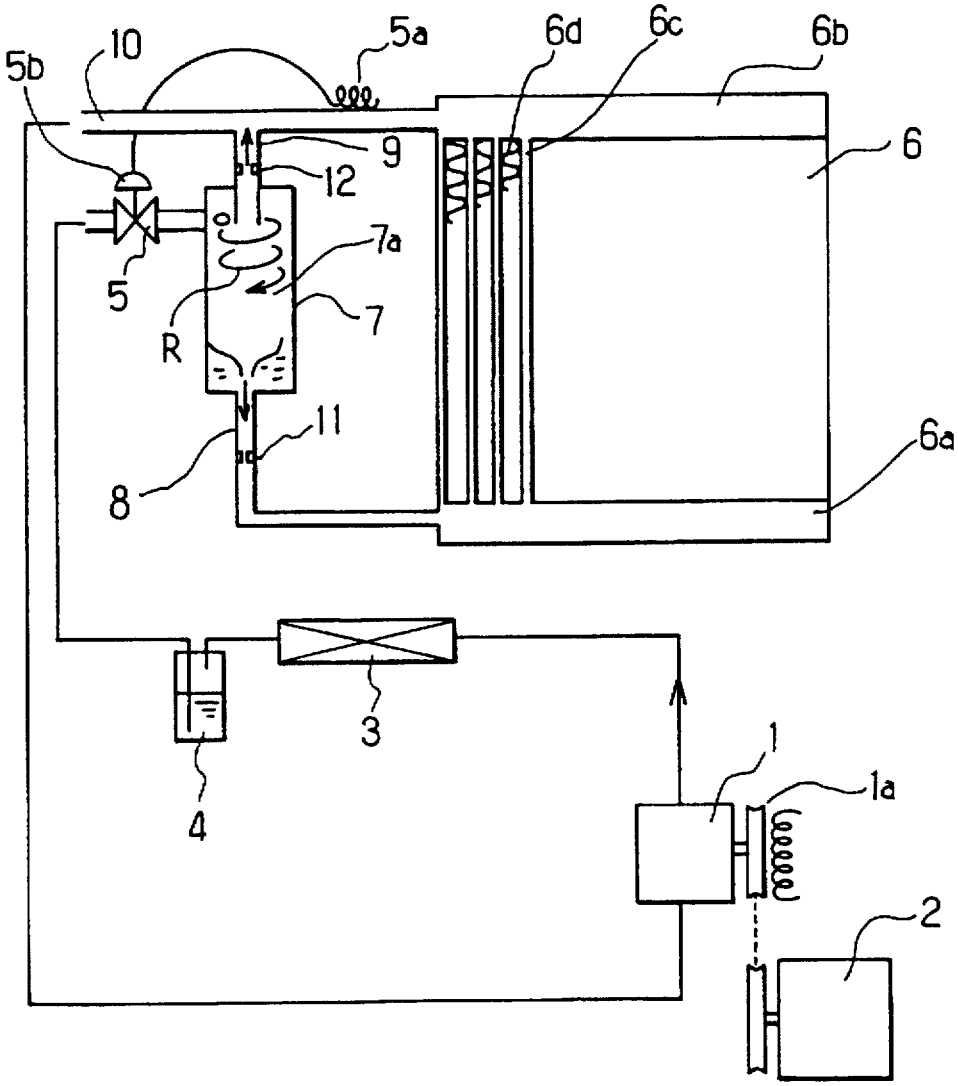
FIG. 1 is a schematic refrigeration apparatus cycle view indicating a first embodiment according to the present invention.

FIG. 1 is a schematic cycle view of a refrigeration apparatus are automotive air-conditioning use. Numeral 1 is a compressor, and is driven by means of an automotive engine (drive source) 2 via an electromagnetic clutch (operation interruption means) 1*a*. Numeral 3 is a condenser which cools and condenses high-temperature and high-pressure gas-phase refrigerant discharged from the compressor 1 by cooling air (cooling medium) blown by a fan not illustrated.

Numeral 4 is a receiver which accumulates liquid-phase refrigerant condensed by the condenser 3 and inducts only liquid-phase refrigerant to the outlet side thereof. Numeral 5 is a temperature-operating type expansion valve constituting a pressure-reducing means to cause pressure reduction and expansion of refrigerant from the receiver 4, and numeral 5*a* is a temperature-sensing tube constituting a temperature-sensing means thereof. Numeral 6 is an evaporator for automotive air-conditioning use for the purpose of cooling and dehumidifying conditioned air blown within a passenger compartment.

This evaporator 6 may have a known structure, being a structure of aluminum or similar metal having good thermal conductivity soldered integrally, having an inlet tank (refrigerant distribution means) 6*a*, outlet tank (refrigerant collection means) 6*b*, multiple tubing of flat configuration (heat exchange portion refrigerant through-flow means) 6*c* structured by joining two metal plates, and corrugated fins (heat exchange surface area expansion means) 6*d* joined among this tubing 6*c*.

Numeral 7 is a centrifugal type separator constituting a gas-liquid separation means to separate gas-liquid two-phase refrigerant pressure-reduced by the foregoing expansion valve 5 into gas and liquid, and is disposed on the downstream side of the expansion valve 5 independently of the expansion valve 5. This centrifugal type separator 7 has an internal space of tubular configuration 7*a* the axis of which is disposed vertically, and creates swirl flow in refrigerant flow by offsetting influx refrigerant from the expansion valve from a center of tubular configuration and causing it to flow tangentially with respect to this space 7*a*, and separates gas-liquid phase refrigerant by means of centrifugal force generated by this swirl flow. That is to say, by centrifugal force due to swirl flow at the internal space of tubular configuration 7*a* of the separator 7, liquid-phase with high specific gravity is shifted to the outer peripheral side, and gas-phase refrigerant with low specific gravity is shifted to the center portion, and accordingly liquid-phase refrigerant is collected on the lower side and gas-liquid phase refrigerant is separated.

Numeral 8 is a liquid-phase refrigerant discharge passage which causes to discharge liquid-phase refrigerant separated by the separator 7 and collected at the lower portion of the space, and is removed from the bottom portion of the separator 7 and communicated with the inlet tank 6*a* of the foregoing evaporator 6. Numeral 9 is a gas-phase refrigerant discharge passage which causes to discharge gas-phase refrigerant separated by the separator 7, and is removed from the center portion of the upper portion of the separator 7. 10 is an evaporator outlet side passage (or, in other words, a compressor intake passage), and causes gas-phase refrigerant from the outlet tank 6*b* of the evaporator 6 and gas-phase refrigerant from the gas-phase refrigerant discharge passage 9 to be united and taken into the compressor 1.

The temperature-sensing tube 5*a* of the foregoing expansion valve 5 is disposed further on the upstream side of the union location of the gas-phase refrigerant discharge passage 9 to the passage 10, so as to detect the temperature of only superheated gas-phase refrigerant evaporated by the evaporator 6. Herein, refrigerant of identical type as refrigeration apparatus circulating refrigerant is enclosed within the temperature-sensing tube 5*a*, the pressure of this enclosed refrigerant changes in accordance with the temperature of the foregoing superheated gas-phase refrigerant and acts on a diaphragm 5*b* of the expansion valve 5. The degree of opening of a needle valve (not illustrated) of the expansion valve 5 is changed by means of displacement of this diaphragm 5*b*, and consequently according to the present embodiment the needle valve operating means is structured by the diaphragm 5*b*.

Numeral 11 is an aperture resistance disposed in the liquid-phase refrigerant discharge passage 8 and constituting an auxiliary pressure-reducing means to again reduce pressure of refrigerant supplied to the evaporator, and concretely it is structured by a orifice (the sectional configuration of a restricting passage thereof being of linear configuration), nozzle (the inlet portion sectional configuration of a restricting passage thereof being of smooth arc configuration), or the like with an inner diameter of approximately 3 mm. Numeral 12 is an aperture resistance provided in the gas-phase refrigerant discharge passage 9 for the purpose of regulating gas-phase refrigerant flow of this passage 9, and concretely it is structured by an orifice, nozzle, short-length capillary tube, or the like.

Figure 2A:
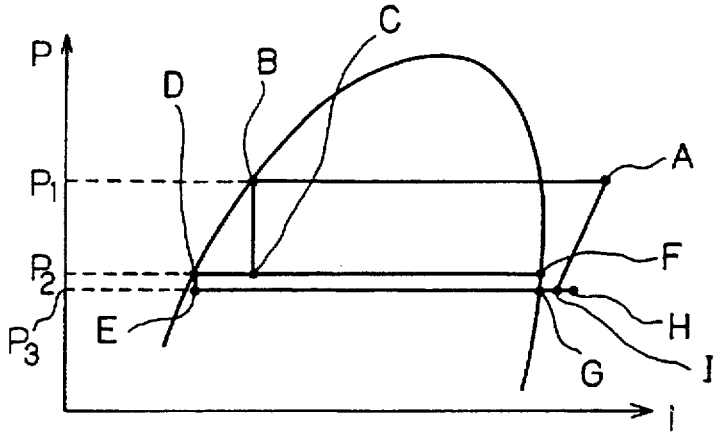
FIGS. 2A , 2B and 2C are Mollier diagrams of respectively differing load conditions.

Next, a mode of operation according to the present embodiment with the above-described structure will be described with reference to the Mollier diagrams of FIGS. 2A, 2B, and 2C. FIG. 2A indicates a state of refrigerant (R134a) of respective portions of the refrigeration apparatus during intermediate load in a spring/autumn period. The high-temperature, high-pressure gas-phase refrigerant of the compressor 1 outlet is point A, and liquid-phase refrigerant condensed by the condenser 3 and accumulated by the receiver 4 flows into the expansion valve 5. The refrigerant of the expansion valve inlet is point B, and gas-liquid two-phase refrigerant after pressure reduction by means of the expansion valve 5 is point C.

High pressure P1 during intermediate load in a spring/autumn period is normally approximately 7 kg/cm$^2$ (=0.80 MPa), and when there is a drop from this high pressure P1 to low pressure P2 (2.5 kg/cm$^2$=0.35 MPa) at the expansion valve 5, the refrigerant dryness x becomes 0.20, and gas with a specific gravity of approximately 20% is generated, but gas-liquid two-phase refrigerant after this pressure reduction is centrifugally separated in the separator 7. This separated liquid-phase refrigerant is point D, and passes from here through the liquid-phase refrigerant discharge passage 8 to be again pressure-reduced by means of the aperture resistance 11, reaching point E of low pressure P3 (2.0 kg/cm$^2$=0.3 MPa). Separated gas-phase refrigerant is point F of saturated gas-phase refrigerant, and passes from here through the gas-phase refrigerant discharge passage 9 to be pressure-reduced by means of the aperture resistance 12, reaching point G. The dryness x of the refrigerant at the foregoing point E is approximately 0.05, and influx refrigerant to the evaporator 6 is substantially all liquid-phase refrigerant, and so the entirety of the heat exchanger portion can be utilized effectively for the purpose of cooling operation, and evaporator performance can be improved, without generating nonuniformity in refrigerant distribution to the respective tubing 6c in the evaporator 6.

In the above-described mode of operation, pressure within the separator 7 means of disposing the aperture resistance 11 in the liquid-phase refrigerant discharge passage 8, and the flow proportions to the respective passages 8 and 9 are regulated so that the gas-liquid separated gas-phase refrigerant and liquid-phase refrigerant respectively flow to the respective passages 8 and 9 in exactly the corresponding amounts. Furthermore, the aperture resistance 12 of the gas-phase refrigerant discharge passage 9 plays a role in preventing an excessive increase in refrigerant flow bypassed through this passage 9, and is not necessarily required.

Superheated gas-phase refrigerant evaporated by the evaporator 6 reaches point H, and thereafter unites with saturated gas-phase refrigerant from the foregoing passage 9 in the evaporator outlet side passage 10, and after the degree of superheating drops somewhat and there is a shift to point I, it is taken into the compressor 1.

Figure 2B:
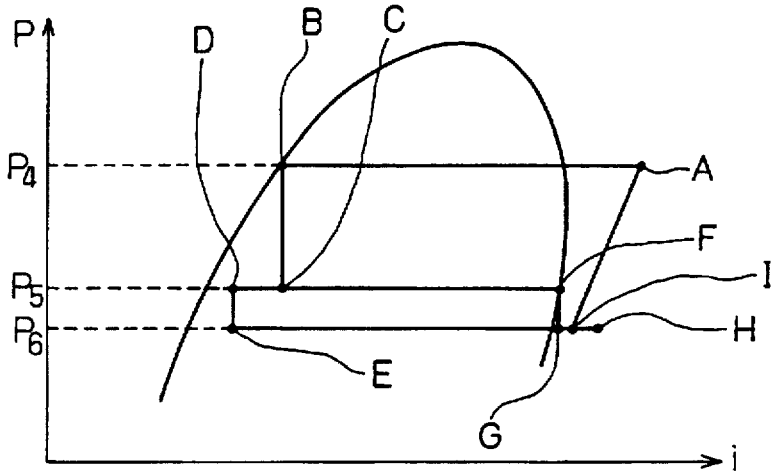

Next, FIG. 2B indicates the refrigerant state of respective portions of the refrigeration apparatus during high load in a summer period. Because high pressure P4 normally rises to 15 kg/cm$^2$=approximately 0.25 MPa, refrigerant of point C (low pressure P5=4 kg/cm$^2$=approximately 0.50 MPa) after pressure reduction by the expansion valve 5 assumes a dryness x of approximately 0.35, and the ratio of the amount of gas increases, and so a portion of the gas-phase refrigerant attempts to be discharged to the liquid-phase refrigerant discharge passage 8 side.

However, because the orifice or nozzle structuring the aperture resistance 11 has a property wherein the through-flow resistance of gas increases sharply in comparison with liquid, when the gas-phase refrigerant attempts to pass through the aperture resistance 11, the through-flow resistance of the liquid-phase refrigerant discharge passage 8 side increases, pressure P5 within the separator 7 increases, and the amount of gas escaping to the gas-phase refrigerant discharge passage 9 side increases. As a result of this, the amount of gas intermixed in the liquid-phase refrigerant discharge passage 8 side does not increases appreciably, and even in a high-load condition wherein high pressure P4=approximately 15 kg/cm$^2$ (=0.25 MPa), the degree of refrigerant dryness x of the evaporator inlet (point E) can be suppressed to a smaller value than approximately 0.15, and by means of this refrigerant distribution to the respective tubing 6c in the evaporator 6 can be maintained in a favorable state, and performance of the evaporator 6 can be assured. Furthermore, low pressure P6 of point E is approximately 2 kg/cm$^2$ (=0.3 MPa).

Figure 2C:
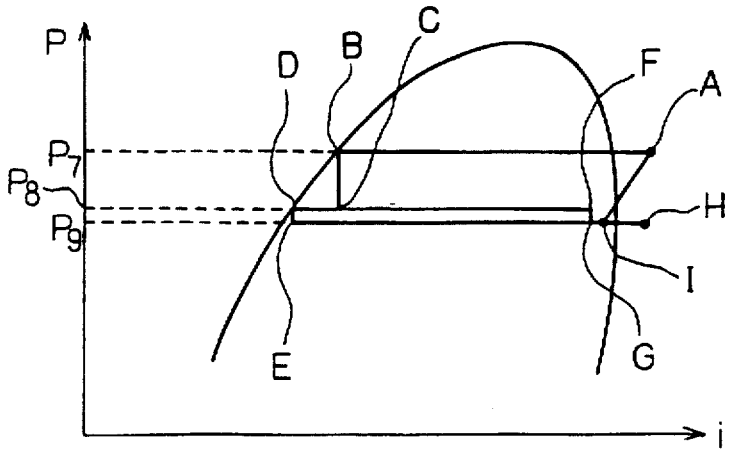

Next, FIG. 2C indicates the refrigerant state of respective portions of the refrigeration apparatus during low load in a winter period. Because high pressure P7 normally declines to approximately 5 kg/cm$^2$, refrigerant of point C (low pressure P8=2.3 kg/cm$^2$=approximately 0.33 MPa) after pressure reduction by means of the expansion valve 5 assumes a degree of dryness x of 0.1, and the ratio of the amount of gas decreases, and so a portion of the liquid-phase refrigerant is discharged to the gas-phase refrigerant discharge passage 9 side.

Meanwhile, because the degree of refrigerant dryness x of the refrigerant at the evaporator inlet (point E) becomes a small value of approximately 0.02, refrigerant distribution to the evaporator tubing 6c naturally becomes favorable, and evaporator performance can be assured.

Additionally, with respect to the compressor 1, refrigerant of moist vapor of point G and superheated gas-phase refrigerant of point H are united, and refrigerant of moist vapor of point I (refrigerant including a portion of liquid) attempts to be taken into the compressor 1, and so return performance of lubrication oil which is frequently a problem in winter periods is improved, and reliability of the compressor 1 is improved. Moreover, low pressure P9 of point E is approximately 2 kg/cm$^2$.

Figure 3:
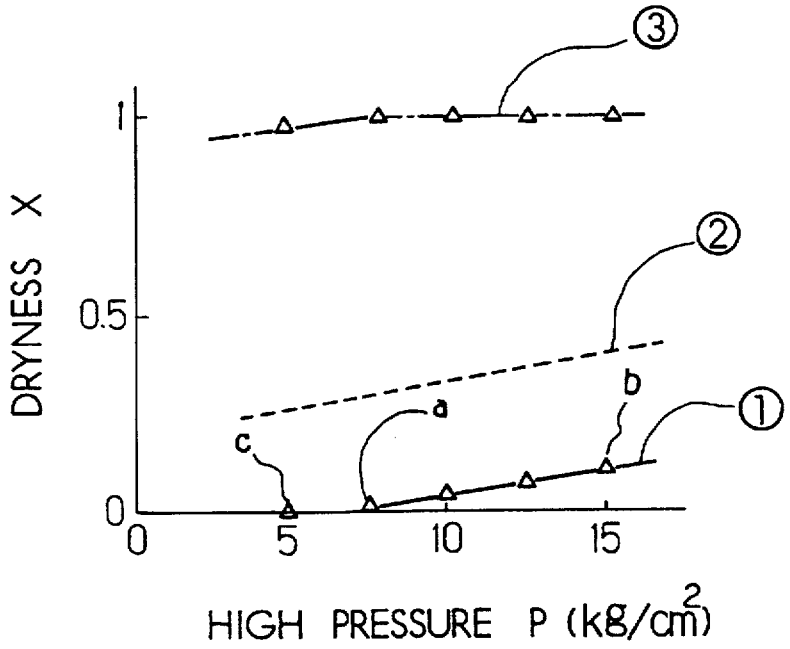
FIG. 3 is a graph indicating a relationship between high pressure and refrigerant dryness of a refrigeration apparatus.

FIG. 3 shows the relation between the dryness x of the refrigerant as the vertical axis and high pressure P of the refrigeration apparatus as the horizontal axis; solid line (1) indicates the dryness x of the refrigerant of the evaporator inlet according to the present invention (point E of FIG. 2). In FIG. 3, (a) indicates the dryness during intermediate load, (b) indicates the dryness during high load, and (c) indicates the dryness during low load. It is understood that, according to the present invention, the dryness x can be constantly maintained at a small value, regardless of load fluctuation.

In contrast to this, the dryness x of an evaporator inlet in an ordinary refrigeration apparatus according to the prior art is, as shown by dotted line (2), a much larger value compared with the apparatus according to the present invention, and is a cause of evaporator performance deterioration.

Moreover, dotted dash line (3) indicates a dryness of refrigerant (point F of FIG. 2) at the inlet of the gas-phase refrigerant discharge passage 9 in an apparatus according to the present invention; it is understood that it is at a state proximate to saturated gas of a constant degree of dryness x=1, regardless of load fluctuation.

Furthermore, as is understood from the foregoing description of the mode of operation, the liquid-phase refrigerant discharge passage 8 and gas-phase refrigerant discharge passage 9 in the present invention are not to be interpreted as exclusively causing to discharge always only liquid-phase refrigerant or gas-phase refrigerant, but refer to a case wherein a portion of gas-phase refrigerant or liquid-phase refrigerant may be intermixed due to fluctuation or the like in load conditions of the refrigeration apparatus, compressor revolving speed, or the like.

(Second Embodiment)

Figure 4:
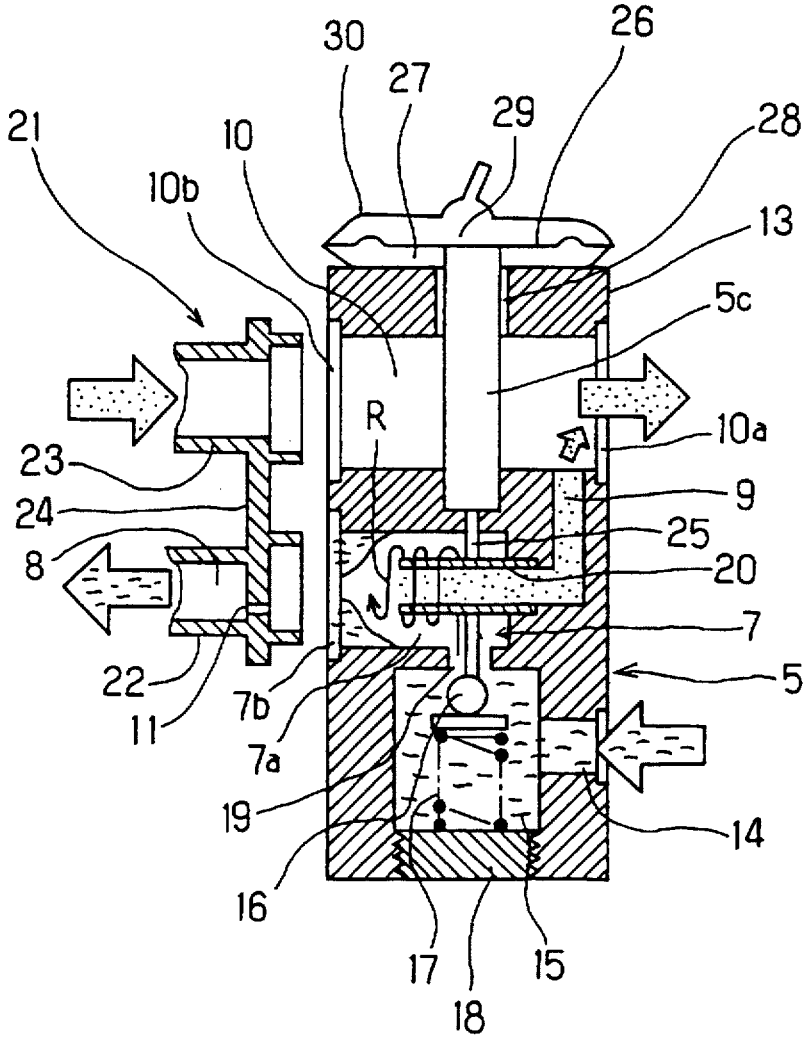
FIG. 4 is a partially vertical sectional view of an expansion valve indicating a second embodiment according to the present invention.
Figure 5:
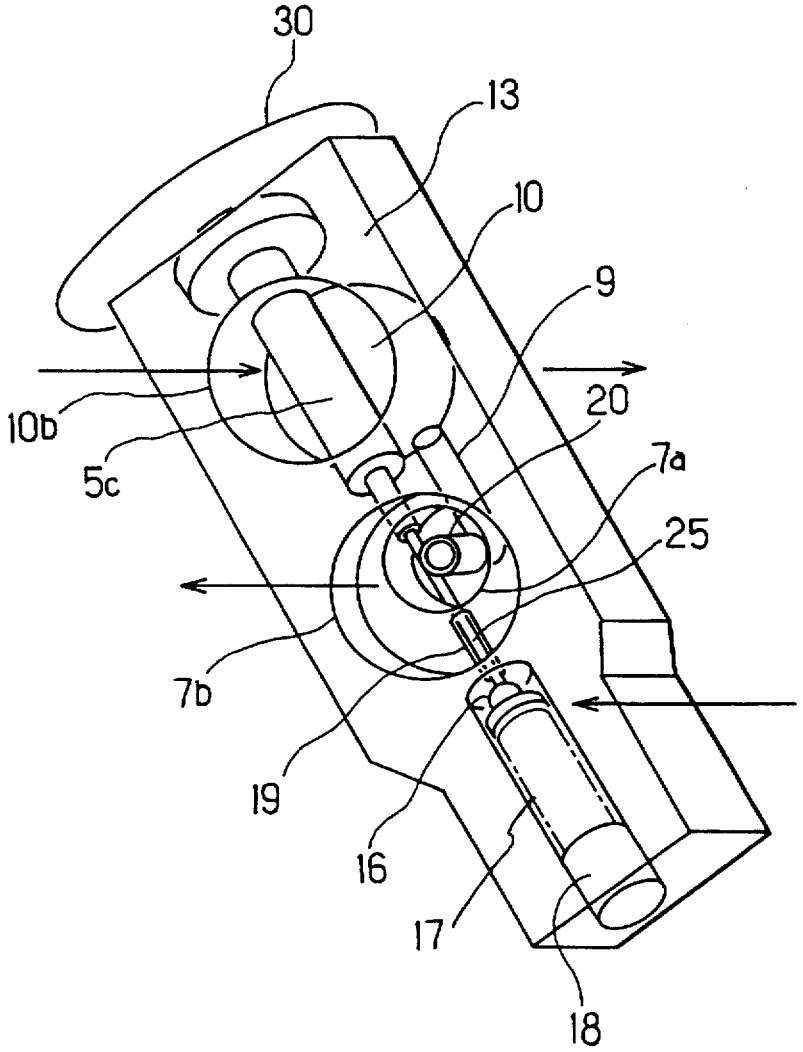
FIG. 5 is a perspective view of the expansion valve of FIG. 4.
Figure 6A:
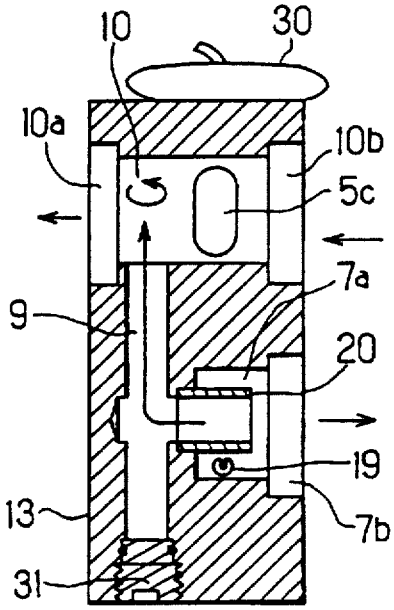
FIG. 6A is a vertical sectional view of an expansion valve section indicating a sectional view taken along line I—I of front view FIG. 6B.
Figure 6B:
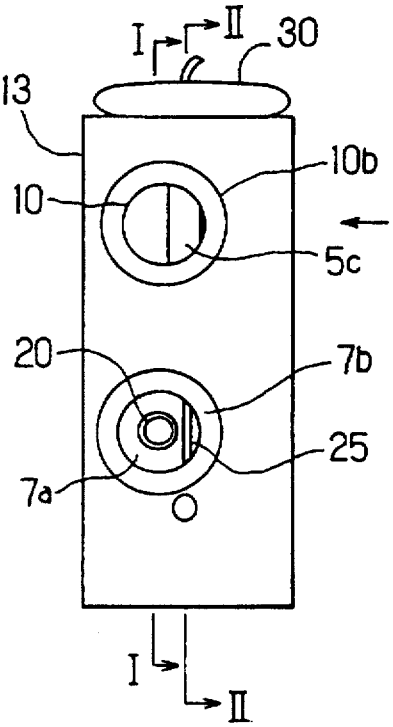
FIG. 6B is a front view of the expansion valve.
Figure 6C:
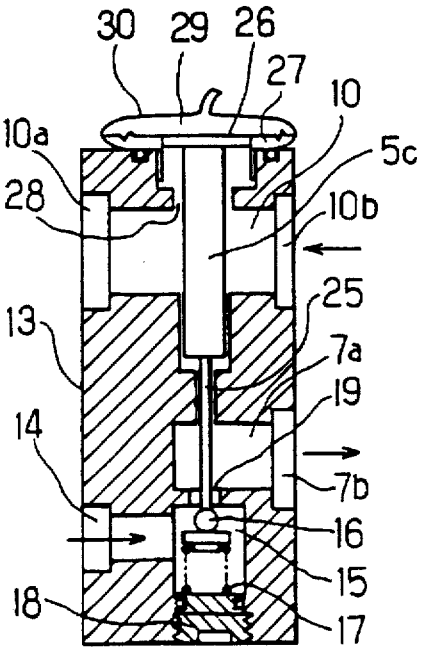
FIG. 6C is a sectional view taken along line II—II of FIG. 6B.
Figure 6D:
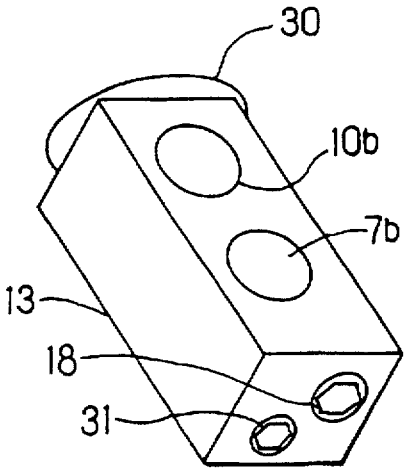
FIG. 6D is a perspective view of the expansion valve section.

FIGS. 4 and 5 indicate a second embodiment, structured by integrating a centrifugal type separator 7 with the above-described expansion valve 5. In FIGS. 4 and 5, numeral 13 is a body case of the expansion valve 5 formed in a substantially cubic configuration by metal of aluminum or the like. The vertical direction of FIG. 2 corresponds to the vertical direction if a state of actual use, and a refrigerant inlet 14 into which liquid-phase refrigerant flows from a receiver 4 is opened on a lower portion right-hand side of this body case 13.

This refrigerant inlet 14 is communicated with a needle valve housing chamber 15 formed on a lower central portion of the body case 13, and a needle valve 16 and valve spring 17 are housed within this chamber 15. The installation load of this spring 17 is adjustable by means of an installation plate 18 fixed by screw to the body case 13. Herein, a liquid-phase refrigerant discharge passage of the expansion valve 5 is structured by the refrigerant inlet 14 and needle valve housing chamber 15.

Numeral 19 is a restricting passage formed on the downstream side of this liquid-phase refrigerant discharge passage for the purpose of reducing pressure of liquid-phase refrigerant. The degree of opening of this restricting passage 19 is adjusted by means of the needle valve 16. According to the present embodiment, a centrifugal type separator 7 is disposed immediately after this restricting passage 19, with this separator 7 disposed in a substantially central portion in the vertical direction of the body case 13. Accordingly, the direction of flow of gas-liquid two-phase refrigerant after pressure reduction squirted out from the restricting passage 19 is offset from the tubular center with respect to an internal space of tubular configuration **7*a* of the separator 7 (see FIG. 5), and so this gas-liquid two-phase refrigerant generates a swirl flow R in this internal space of tubular configuration 7*a***.

Numeral 20 is a gas-phase induction pipe disposed so as to protrude from a central location of the internal space of tubular configuration **7*a* of the separator 7, and is connected to a gas-phase refrigerant discharge passage 9. According to the present embodiment, this passage 9 itself is caused to double in duty with the role of the aperture resistance 12 of FIG. 1 by establishing the inner diameter of this passage 9 appropriately. An evaporator outlet side passage 10 is formed in an upper portion of this body case 13 so as to pass therethrough laterally in tubular configuration, and an outlet portion of the gas-phase refrigerant discharge passage 9 is united at a rightward (i.e., toward the outlet) section in the lateral direction of this passage 10**.

A temperature-sensing member **5*c* of the expansion valve 5 constitutes a temperature-sensing means to sense temperature of superheated gas-phase refrigerant evaporated by an evaporator 6, and is disposed at a location in the evaporator outlet side passage 10 further on the upstream side than the union location of the outlet portion of the foregoing gas-phase refrigerant discharge passage 9 so that the temperature of the foregoing superheated gas-phase refrigerant can be detected accurately. An outlet end 10*a* of the passage 10 is connected to the intake side of a compressor 1, and an inlet end 10*b* is connected to an outlet tank 6*b* of the evaporator 6**.

Numeral 21 is a joint member constituting a passage connecting means, and is formed in a configuration wherein first and second pipe portions 22 and 23 are formed integrally with an interconnecting plate 24 of a metal being aluminum or the like. The first pipe portion 22 forms the liquid-phase refrigerant discharge passage 8 of FIG. 1, and an aperture resistance 11 composed of an orifice is formed intermediately therein. This first pipe portion 22 connects an opening end **7*b* of the internal space of tubular configuration 7*a* of the centrifugal type separator 7 and an inlet tank 6*a* of the evaporator 6, and according to the present is modified as will be described below for the purpose of guiding centrifugally separated liquid-phase refrigerant favorably to the foregoing aperture resistance 11** side.

Briefly, the diameter of the opening end **7*b* in the centrifugal type separator 7 is enlarged with respect to the internal space of tubular configuration 7*a*, and along with this, the center of the opening end 7*b* is lowered to lower than the center of the space 7*a* (see FIG. 5), and accordingly the location of the aperture resistance 11 is established so as to oppose a section lower than the center of this opening end 7*b*. By means of this, liquid-phase refrigerant centrifugally separated, shifted to an outer peripheral side, and collected in the internal space of tubular configuration 7*a* is collected at a lower portion of the opening end 7*b* by means of gravity, and thereafter can be caused to flow smoothly into the passage of the aperture resistance 11**.

The second pipe portion 23 of the joint member 21 connects the outlet tank **6*b* of the evaporator 6 and the inlet end 10*b* of the evaporator outlet side passage 10**.

Next, to describe the operating mechanism of the needle valve 16 of the expansion valve 5, the needle valve 16 is interconnected integrally with an operating rod 25, an upper end of this operating rod 25 contacts the temperature-sensing member **5*c*, and according to the present embodiment this temperature-sensing member 5*c* is structured from a cylindrical body formed of aluminum or similar metal having good thermal conductivity. Accordingly, the upper end of this temperature-sensing portion 5*c* contacts a diaphragm 26 disposed on an outer-surface side of an uppermost portion of the body case 13, and so the needle valve 16 is also displaced via the temperature-sensing member of cylindrical configuration 5*c* and operating rod 25 in correspondence with vertical displacement of this diaphragm 26**.

A space 27 on the lower side of the diaphragm 26 is communicated with the evaporator outlet side passage 10 via a communicating passage 28 on the perimeter of the temperature-sensing member **5*c*, and so pressure within the space 27 is identical to the pressure of the passage 10. Meanwhile, a space 29 on an upper side of the diaphragm 26 is sealed by a cover 30, and moreover refrigerant of identical type as circulating refrigerant of the refrigeration apparatus is enclosed in the interior thereof. This enclosed gas conducts, via the metal diaphragm 26, the superheated gas-phase refrigerant temperature of the evaporator outlet sensed by the temperature-sensing member 5*c*, and exhibits pressure changes in correspondence to this superheated gas-phase refrigerant temperature. The diaphragm 26** is abundant in elasticity and has good thermal conductivity, and is preferably formed with a tough material, being composed for example of stainless steel or a similar metal.

Because the operating mechanism of the needle valve 16 of the expansion valve 5 is structured in the above-described manner, the needle valve 16 is displaced by a balance of pressure corresponding to superheated gas-phase refrigerant temperature compressing the diaphragm 26 downwardly, refrigerant pressure of the passage 10 compressing the diaphragm 26 upwardly, and installation load of the spring 17, by means of which the degree of opening of the restricting passage 19 is controlled so as to maintain the degree of superheating of the gas-phase refrigerant of the evaporator outlet at a predetermined value. Consequently, according to the present embodiment, a needle valve operating means is structured by means of the temperature-sensing member **5*c*, diaphragm 26**, and the like.

As described above, the second embodiment indicated in FIGS. 4 and 5 is characterized by a centrifugal type separator 7 built into the expansion valve 5 as an integral structure, and is identical to the first embodiment in other respects, and so because the mode of operation as the refrigeration apparatus indicated in FIGS. 2 and 3 is similar for the second embodiment as well, description thereof will be omitted.

(Third Embodiment)

FIGS. 6A through 6D indicates a third embodiment which is a slight modification of the structure of the second embodiment. According to the present embodiment, a gas-phase refrigerant discharge passage 9 is formed by hole-drilling upwardly from a bottom surface of a body case 13, and so an opening end below this passage 9 is sealed by a closing member 31.

(Fourth Embodiment)

FIGS. 7 to 10 describe a fourth embodiment applying the present invention in a refrigeration apparatus for automotive air-conditioning use provided with an evaporation pressure regulating valve (hereinafter termed an "EPR").

According to the refrigeration apparatus for automotive air-conditioning indicated in FIG. 1, in order to prevent a decline in cooling performance due to frosting of an evaporator 6, blown air temperature of the evaporator 6 is normally detected by a temperature sensor (not illustrated) being a thermistor or the like, and ON-OFF control of running of a compressor 1 is performed in accordance with the detected temperature thereof.

That is to say, if blown air temperature drops to an established temperature of for example 3° C., electrical conduction of an electromagnetic clutch 1*a* is interrupted and the compressor 1 is stopped, thereby causing the temperature of the evaporator 6 to drop to 0° C. or less and preventing the occurrence of frosting. Accordingly, if blown air temperature rises to an established temperature of for example 4° C., ON-OFF control is performed to electrify the electromagnetic clutch 1*a* and start the compressor 1.

According to experimentation and investigation by the inventor, it was discovered that the problem which will be described next occurs in a case of ON-OFF control of running of the foregoing compressor 1 according to the structure of the first embodiment indicated in FIG. 1.

Figure 8A:
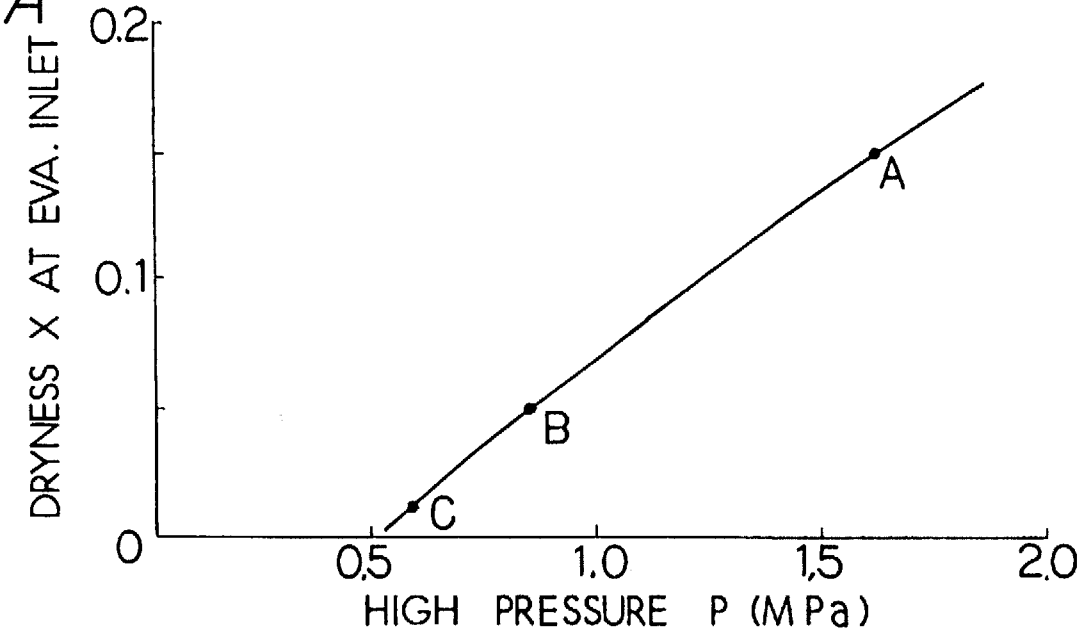
FIG. 8A is a graph indicating a relationship between high pressure and refrigerant dryness at the evaporator inlet side in the fourth embodiment.

Briefly, FIG. 8A takes high-pressure pressure P of the cycle as the horizontal axis and the refrigerant degree of dryness X of the evaporator inlet as the vertical axis. In the drawing, A indicates a refrigerant dryness X of the evaporator inlet under high-load conditions of evaporator intake air (conditioned air) temperature: 35° C., humidity: 60%, amount of air: 480 $m^3/h$, and cycle low-pressure pressure: 0.3 MPa.

B indicates a refrigerant dryness X of the evaporator inlet under intermediate-load conditions of evaporator intake air (conditioned air) temperature: 27° C., humidity: 50%, amount of air: 480 $m^3/h$, and cycle low-pressure pressure: 0.3 MPa.

C indicates a refrigerant degree of dryness X of the evaporator inlet under low-load conditions of evaporator intake air (conditioned air) temperature: 25° C., humidity: 30%, amount of air: 300 $m^3/h$, and cycle low-pressure pressure: 0.3 MPa.

Figure 8B:
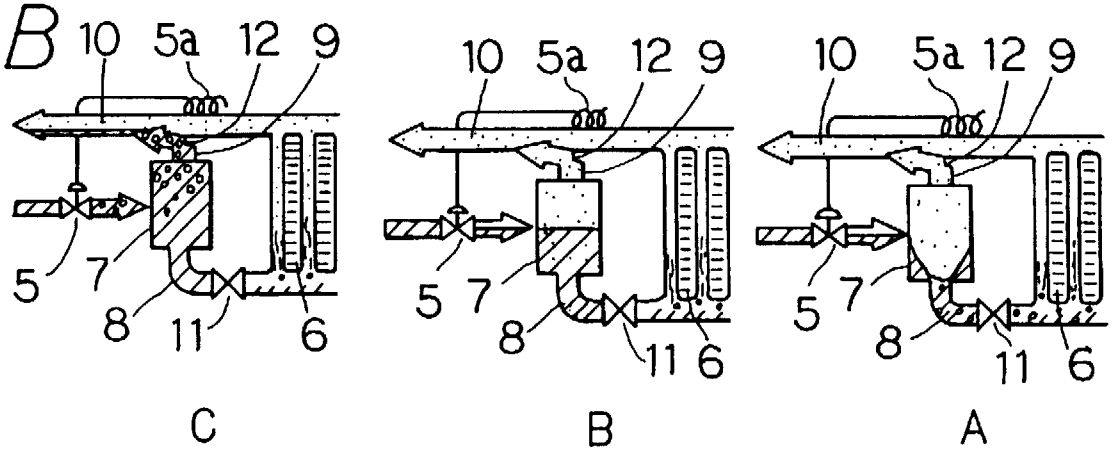
FIG. 8B shows cycle behavior of a refrigeration apparatus at A, B and C points in the graph of FIG. 8A.

According to FIG. 8B, to describe cycle behavior with respect to the broad-ranging conditions indicated by the foregoing A, B, and C, under the high-load conditions of point A, the dryness X of the refrigerant immediately after the expansion valve 5 (inlet of the evaporator 6) is large, and so the generated amount of gas-phase refrigerant increases. For this reason, even if the main stream of gas-phase refrigerant is bypassed to the gas-phase refrigerant discharge passage 9, a portion of the gas-phase refrigerant is intermixed into the liquid-phase refrigerant of the liquid-phase refrigerant discharge passage 8 (see model A below FIG. 8A).

Next, under the intermediate-load conditions of point B, the degree of dryness X of the refrigerant immediately after the expansion valve 5 is reduced, the generated amount of gas-phase refrigerant becomes equal to the amount of gas-phase refrigerant bypassed to the gas-phase refrigerant discharge passage 9, and the two assume a balanced state, and so intermixing of gas-phase refrigerant into the liquid-phase refrigerant of the liquid-phase refrigerant discharge passage 8 disappears (see model B below FIG. 8B).

Finally, under the low-load conditions of point B, the degree of dryness X of the refrigerant immediately after the expansion valve 5 is reduced and the generated amount of gas-phase refrigerant is reduced further, and so a portion of the liquid-phase refrigerant is also bypassed to the gas-phase refrigerant discharge passage 9 side. In this case, naturally, only liquid-phase refrigerant flows on the liquid-phase refrigerant discharge passage 8 side, and gas-phase refrigerant is not intermixed (see model C below FIG. 8C).

According to a system establishing refrigerant flow ratios to the two refrigerant passages 8 and 9 by fixed aperture resistances 11 and 12 in this manner, under low-load conditions wherein high- and low-pressure differential pressure is small and the amount of gas generated downstream of the expansion valve 5 is small, bypassing of liquid-phase refrigerant to the gas-phase refrigerant discharge passage 9 side cannot be avoided.

Figure 9B:
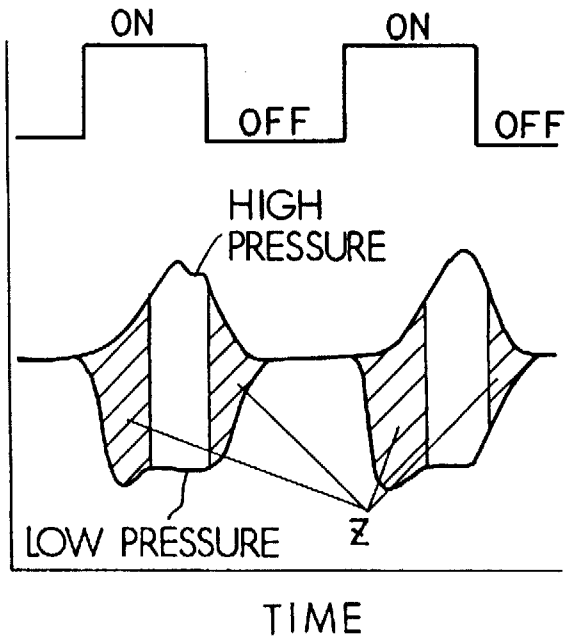
FIG. 9B is an operation characteristic diagram of an ON-OFF control cycle.

However, as shown in FIG. 9B, in an ON-OFF control cycle, high-pressure and low-pressure pressures of the cycle fluctuate greatly each time ON-OFF control for the compressor 1 is performed, and accordingly a region Z wherein high- and low-pressure differential pressure drops excessively to a predetermined value or less is generated during the initial starting period and immediately after running stoppage of the compressor 1.

In this region Z, the cycle conditions of point C of the foregoing FIG. 8 are effected, and liquid-phase refrigerant discharge (bypass) to the gas-phase refrigerant discharge passage 9 occurs. ON-OFF control of the compressor 1 is performed frequently and repeatedly, and so the amount of liquid-phase refrigerant bypass increases, causing the problem of an increase in compressor drive power.

In order to solve this problem, reducing the aperture of the aperture resistance 12 of the gas-phase refrigerant discharge passage 9 may be considered, but if the aperture of this aperture resistance 12 is reduced, it invites a decrease in the bypass amount of gas-phase refrigerant to the gas-phase refrigerant discharge passage 9 during constant running of the compressor 1, and the amount of decrease of the bypass amount of this refrigerant causes the phenomenon of an increase in the amount of gas-phase refrigerant to the liquid-phase refrigerant discharge passage 8 without change. This conflicts with the aim of causing a decrease in the refrigerant degree of dryness at evaporator 6 inlet and achieving uniformity in refrigerant distribution, which is an object of the present invention, and is not preferred.

Figure 7:
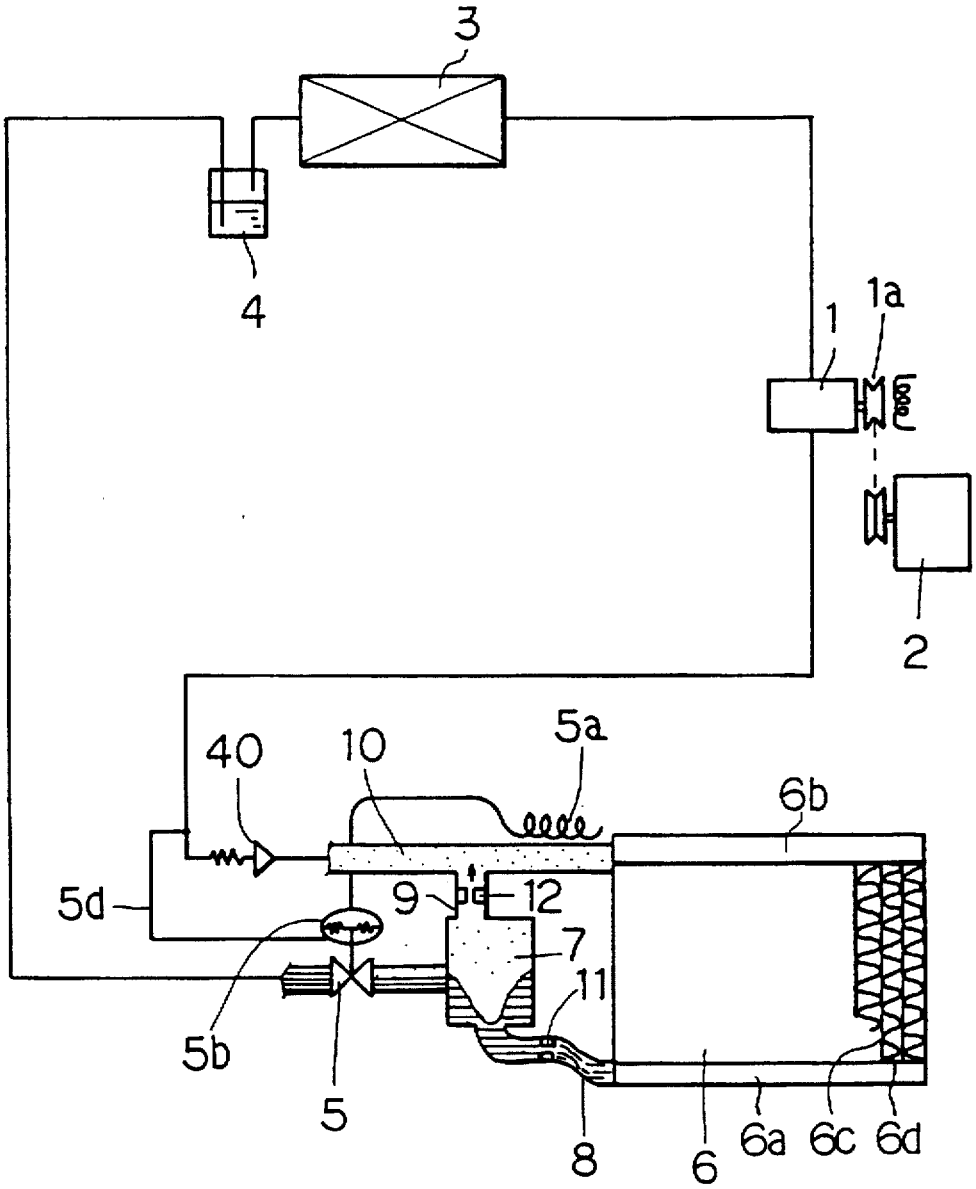
FIG. 7 is a schematic view of a refrigeration cycle indicating a fourth embodiment according to the present invention.

Accordingly, as a means for the purpose of preventing frosting of the evaporator 6, the fourth embodiment disposes an EPR 40 on the downstream side of the evaporator 6 as shown in FIG. 7. By means of regulating refrigerant evaporation pressure at the evaporator 6 to a predetermined value or more by means of the EPR 40, ON-OFF control of the compressor 1 is rendered unnecessary.

Figure 10A:
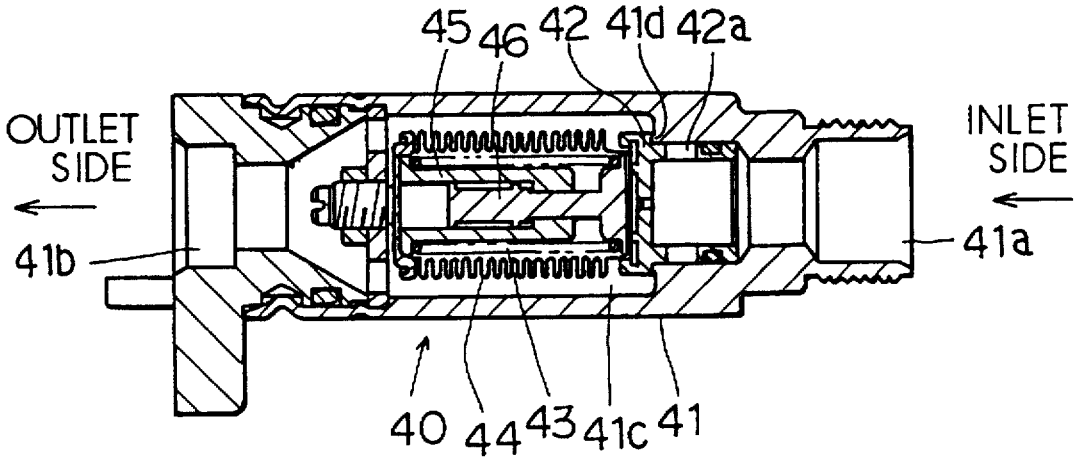
FIGS. 10A and 10B are sectional views of an EPR employed in the fourth embodiment.
Figure 10B:
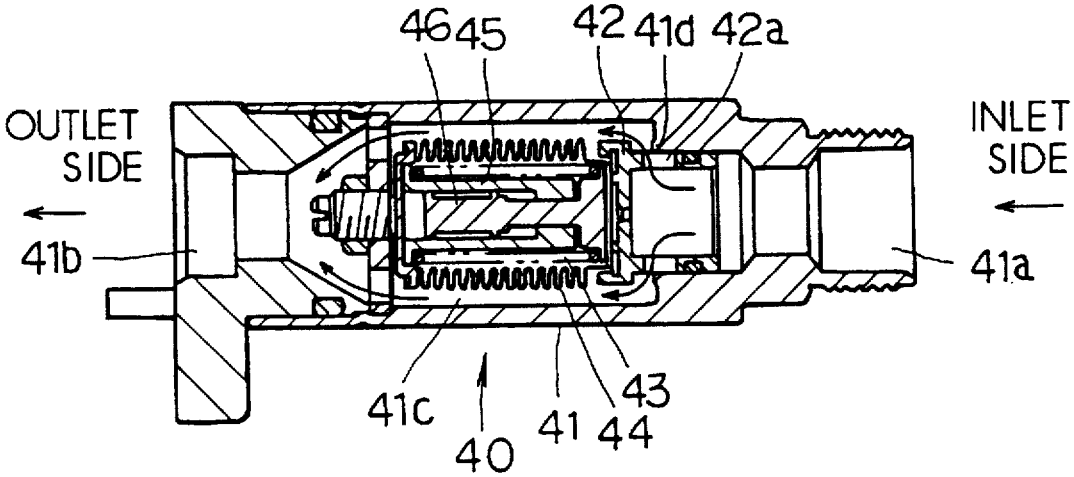

Concretely, this EPR 40 is structured as shown in FIGS. 10A and 10B; an inlet 41*a* and outlet 41*b* are formed on a needle valve body 41, and a refrigerant path 41*c* communicating the inlet 41*a* and outlet 41*b* is formed in the interior thereof. In this refrigerant path 41*c*, a needle valve 42 of spool configuration for path opening/closing is disposed slidably in the lateral directions of the drawing.

This needle valve 42 is constantly compressed in the right-hand direction of the drawing (i.e., inlet 41*a* side) by means of a coil spring 43 so as to contact and close a valve seat portion 41*d* of the needle valve body 41. The spring 43 is housed within an expandable bellows 44. An inert gas (for example $N_2$ gas) is enclosed within this bellows 44 at a predetermined pressure (for example 1 kg/cm$^2$), minimizing the influence of secondary pressure of the refrigerant path 41*c* on the opening/closing operation of the needle valve 42.

Additionally, two guide members 45 and 46 are disposed on an inner peripheral side of the spring 43; the guide member 46 is mated slidably with an inner peripheral surface of the guide member 45. In addition, a plurality of open portions for the purpose of causing refrigerant to flow when the valve is open are provided on a portion of tubular configuration of the needle valve 42 so as to open radially.

When refrigeration load (cooling load) becomes small and the refrigerant evaporation pressure of the evaporator 6 (refrigerant pressure on the inlet 41*a* side) drops, the needle valve 42 is compressed to the right hand-side (i.e., the inlet 41*a* side) by the force of the spring 43 as is shown in FIG. 10 A, and contacts the valve seat portion 41*d* of the needle valve body to close the valve. By means of this, evaporation pressure is maintained at a predetermined value.

Conversely, when refrigeration load (cooling load) becomes large and the refrigerant evaporation pressure of the evaporator 6 (refrigerant pressure on the inlet 41*a* side) rises, the needle valve 42 resists the force of the spring 43 and is compressed to the left-hand side (i.e., the outlet 41*b*) side, and is released from the valve seat portion 41*d* of the needle valve body 41. By means of this, refrigerant flows through the path through the open portions 42*a* of the needle valve 42, the EPR 40 assumes a valve-open state, and refrigeration performance of the specified period is demonstrated.

In this foregoing manner, the evaporation pressure of refrigerant is maintained at not less than a predetermined value (for example, in a case of R134a refrigerant, the equivalent of 0.3 MPa and 0° C. refrigerant evaporation temperature), and occurrence of frost on the evaporator 6 can be prevented.

In FIG. 7. The gas-phase refrigerant discharge passage 9 is connected in the evaporator outlet side passage 10 at an intermediate location discharge of the disposed location of the temperature-sensing tube 5*a* of the expansion valve 5 and upstream of the EPR 40, and additionally an outer-average tube 5*d* of the expansion valve 5 is connected to the downstream side of the EPR 40, to induct refrigerant pressure of the EPR 40 downstream side to a diaphragm 5*b*).

Consequently, the expansion valve 5 controls the needle valve degree of opening by means of the refrigerant temperature of the evaporator 6 outlet detected by means of the temperature-sensing tube 5*a*, the refrigerant pressure of the EPR 40 downstream side, and a priorly established spring (not illustrated; see the spring 17 of FIGS. 4, 5, and 6) installation load.

Figure 9A:
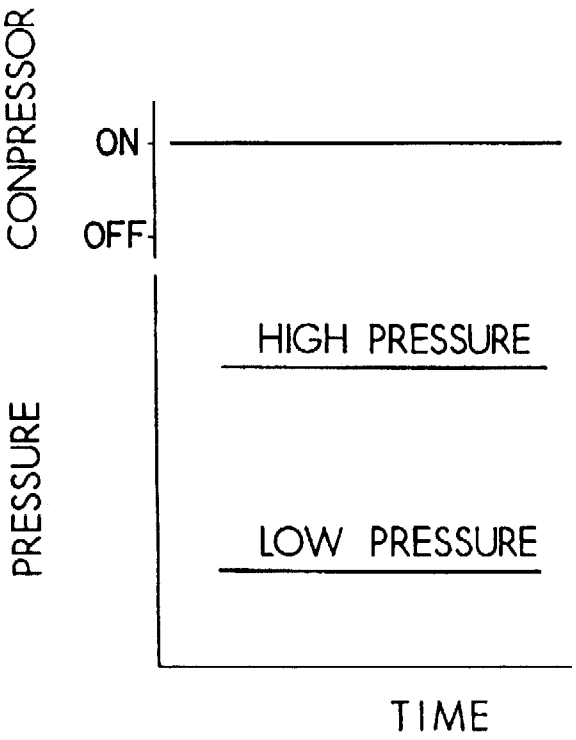
FIG. 9A is an operation characteristic diagram of the fourth embodiment.

According to the fourth embodiment, refrigerant evaporation pressure of the evaporator 6 is controlled at not less than a predetermined value by means of the EPR 40, and so the need to perform ON-OFF control of the compressor 1 for the purpose of frost prevention of the evaporator 6 is eliminated. For this reason, as shown in FIG. 9A the compressor 1 is maintained without change in an ON (operating) state, and so high-pressure pressure and low-pressure pressure of the cycle are also maintained substantially uniformly if the refrigeration (cooling) cycle is uniform. Consequently, liquid-phase refrigerant bypassing to the gas-phase refrigerant discharge passage 9 caused by a decline of the high- and low-pressure differential pressure to the predetermined value or less does not occur.

Moreover, according to the structure of the fourth embodiment, there is no particular need to reduce the aperture resistance 12 of the gas-phase refrigerant discharge passage, and so the problem of an increased amount of gas-phase refrigerant discharge to the liquid-phase refrigerant discharge passage 8 during constant running of the compressor 1 also does not occur.

(Fifth Embodiment)

In a cycle according to the fourth embodiment indicated in FIG. 7, the outer-average tube 5*d* of the expansion valve 5 is connected to the EPR 40 downstream side, and during low-load conditions when the EPR 40 restricts the degree of valve opening thereof to control evaporation pressure, the pressure drop of the EPR 40 outlet side is inducted to the diaphragm 5*b* of the expansion valve 5 by means of the outer-average tube 5*d*. By means of this, foregoing low load the degree of opening of the expansion valve 5 is forcibly caused to increase, liquid-phase refrigerant containing lubrication oil is returned to the compressor 1, and insufficient lubrication in the compressor 1 is prevented.

However, in a cycle according to the present invention, during low load wherein the EPR 40 is actuated, liquid-phase refrigerant containing lubrication oil can be caused to bypass to the gas-phase refrigerant discharge passage 9 by means of adjusting the ratio of the two aperture resistances 11 and 12, and insufficient compressor lubrication during low load can be solved by means of this liquid-phase refrigerant bypass.

Figure 11:
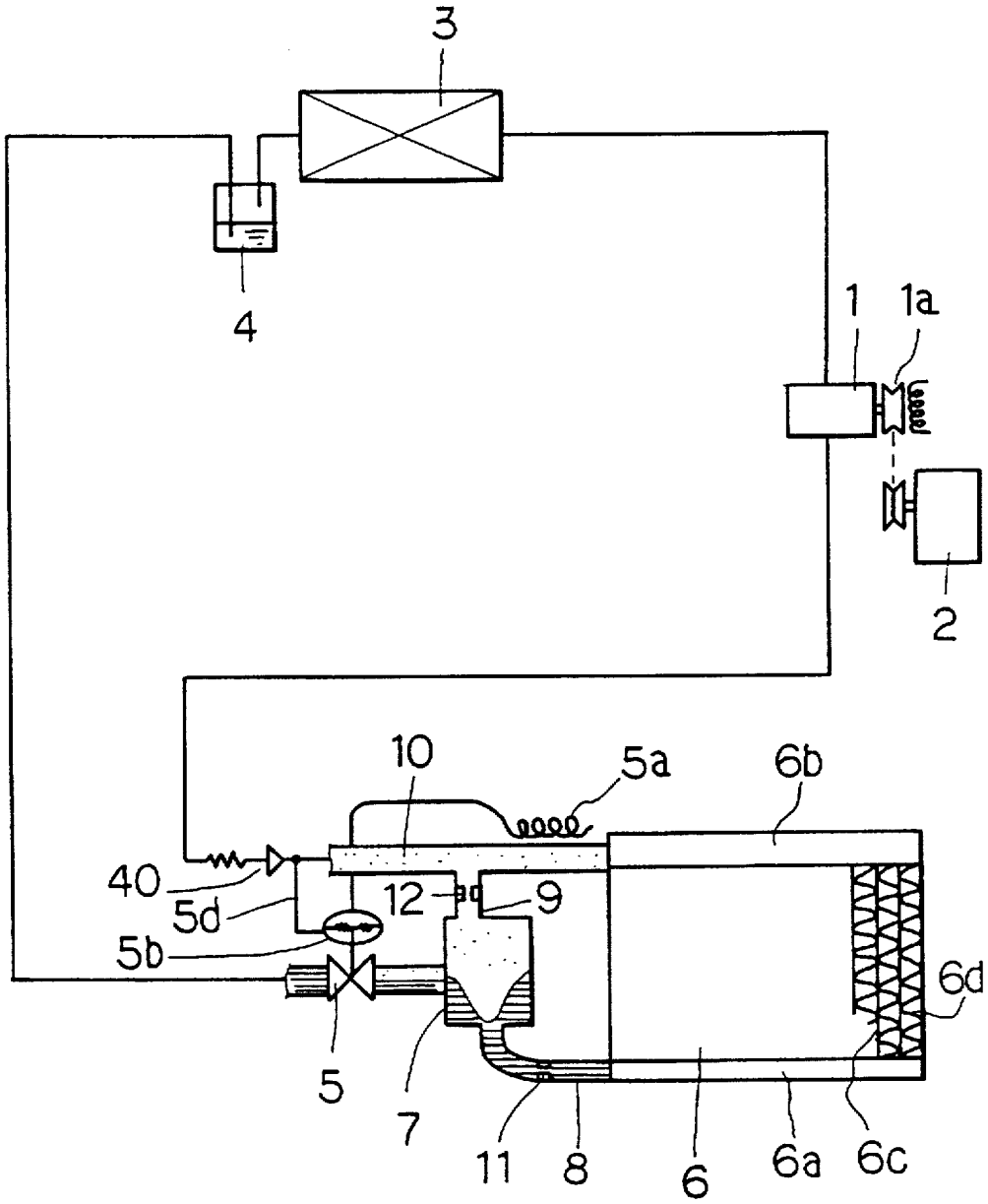
FIG. 11 is a schematic refrigeration apparatus cycle view indicating a fifth embodiment according to the present invention.

A fifth embodiment addresses this point; as shown in FIG. 11, an outer-average tube 5*d* of an expansion valve 5 is connected to an inlet side of an EPR 40, and in other respects the fifth embodiment is identical to the fourth embodiment.

According to the fourth embodiment, an increase in refrigerant discharge due to an increased degree of opening of the expansion valve 5 and an increase in compressor power consumption on the basis thereof occur during low load, but according to the fifth embodiment, the expansion valve 5 adjusts refrigerant flow so that the degree of refrigerant superheating of the evaporator outlet assumes a predetermined value even during low load when the EPR 40 is actuated, and so compressor power consumption can be reduced without generating excessive refrigerant flow, and so the performance coefficient of the refrigeration cycle can be improved.

(Sixth Embodiment)

Figure 12:
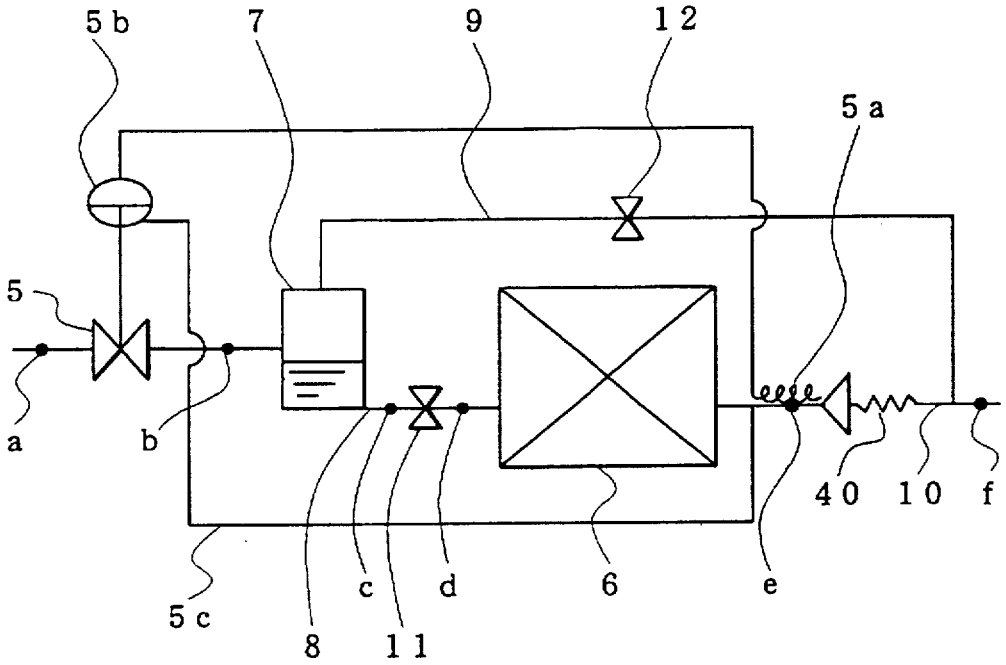
FIG. 12 is a schematic cycle view of the essentials of a refrigeration apparatus indicating a sixth embodiment according to the present invention.

In a further modification of the fifth embodiment, as shown in FIG. 12, the gas-phase refrigerant discharge passage 9 is connected to an outlet side of the EPR 40, and refrigerant from this passage 9 is caused to be bypassed directly to downstream of the EPR 40.

Figure 13:
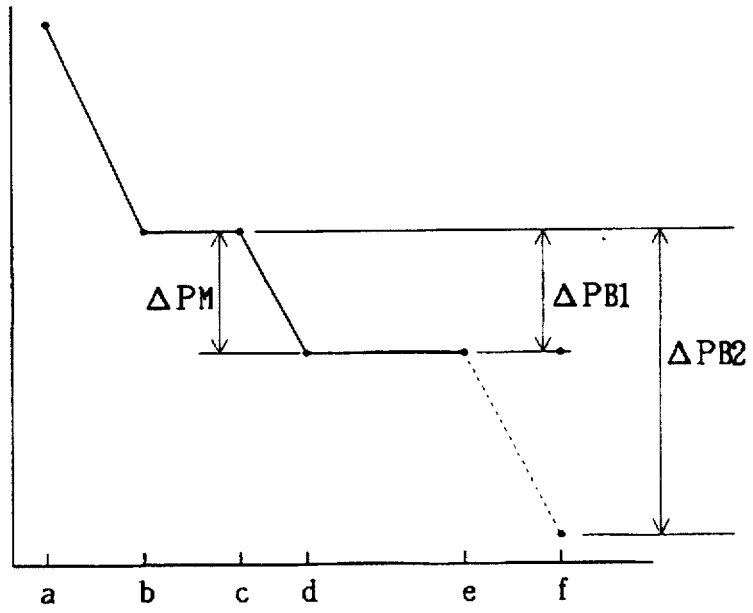
FIG. 13 is an operation characteristic diagram of the sixth embodiment.

FIG. 13 indicates the refrigerant pressures of respective portions a through f of FIG. 12. The a through f of the horizontal axis of FIG. 13 indicate the respective portions a through f of FIG. 12.

The solid lines of FIG. 13 indicate the refrigerant pressures of the respective portions when fully open (during high load), and the broken lines indicate the refrigerant pressures of the respective portions during EPR actuation (during low load). During EPR actuation, the pressure of point f of the EPR outlet side drops as shown by the broken line due to a path-restricting action by means of the needle valve 42 of the EPR 40.

The flow ratio of refrigerant to the liquid-phase refrigerant discharge passage 8 and the gas-phase refrigerant discharge passage 9 is mainly determined by the aperture of the aperture resistances 11 and 12, and secondly is determined by the before and after differential pressures of the respective aperture resistances 11 and 12. The sixth embodiment addresses the before and after differential pressures of these respective aperture resistances 11 and 12, causing liquid-phase refrigerant to be bypassed effectively to the gas-phase refrigerant discharge passage 9 only during low load, when liquid-phase refrigerant return to the compressor 1 is required.

Specifically, to describe a mode of operation of the sixth embodiment, refrigerant flow within the cycle increases during high load, and so refrigerant return to the compressor 1 is unnecessary. During this high load, the needle valve 42 of the EPR 40 is opened fully, and so the pressure of the outlet point f of the EPR 40 is substantially identical to the inlet point d of the evaporator 6.

Consequently, the before and after differential pressure ΔPM of the aperture resistance 11 of the liquid-phase refrigerant discharge passage 8 and the before and after differential pressure ΔPB1 of the aperture resistance 11 of the gas-phase refrigerant discharge passage 9 come to be substantially identical. In a condition wherein these two before and after differential pressures are substantially identical, the aperture ratio of the aperture resistances 11 and 12 is established priorly so that liquid-phase refrigerant is not bypassed to the gas-phase refrigerant discharge passage 9 side, and thereby bypass of liquid-phase refrigerant to the gas-phase refrigerant discharge passage 9 side does not occur.

Meanwhile, during low load, the pressure of point f of the EPR outlet side drops as shown by the broken line due to a path-restricting action by means of the a 42 of the EPR 40. Because of this, the before and after differential pressure of the aperture resistance 12 of the gas-phase refrigerant discharge passage 9 increases as indicated by ΔPB2. For this reason, bypass flow to the gas-phase refrigerant discharge passage 9 increases, and liquid-phase refrigerant can be caused to be bypassed to the passage 9 side.

As a result of this, according to the sixth embodiment, the phenomenon whereby pressure of point f of the EPR 40 outlet drops at the time of a low-load condition wherein the EPR 40 is actuated is utilized, and liquid-phase refrigerant return can be achieved only when liquid-phase refrigerant return is required, without adding a special structure.

(Seventh Embodiment)

The above-mentioned fourth through sixth embodiments described a case wherein an EPR 40 is utilized as a means of preventing frost formation on the evaporator 6, but a seventh embodiment utilizes as the compressor 1 a variable-capacity type which can continuously vary the discharge capacity thereof, maintaining evaporation pressure at a predetermined value or more by means of continuously controlling the capacity of the compressor 1 so as to prevent frost formation of the evaporator 6.

That is to say, FIG. 9A indicates compressor 1 ON-OFF and high- and low-pressure pressures in a case of an EPR cycle, but if the refrigeration (cooling) load is stable with the compressor 1 remaining on, similarly to FIG. 9A, high pressure and low pressure are maintained uniformly even in a cycle employing a compressor 1 of variable-capacity type.

Figure 14:
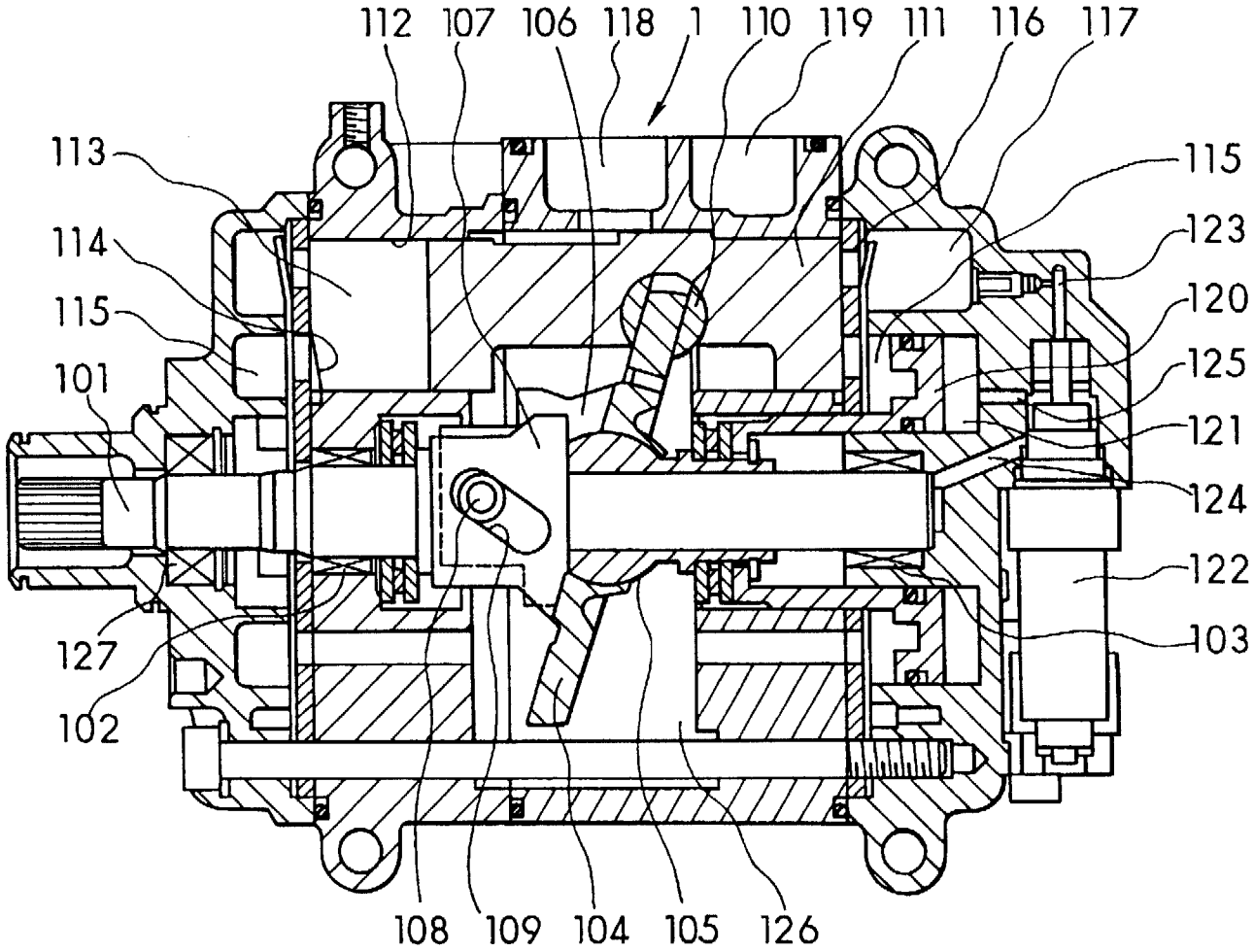
FIG. 14 is a sectional view of a variable-capacity compressor employed in a seventh embodiment.
Figure 15:
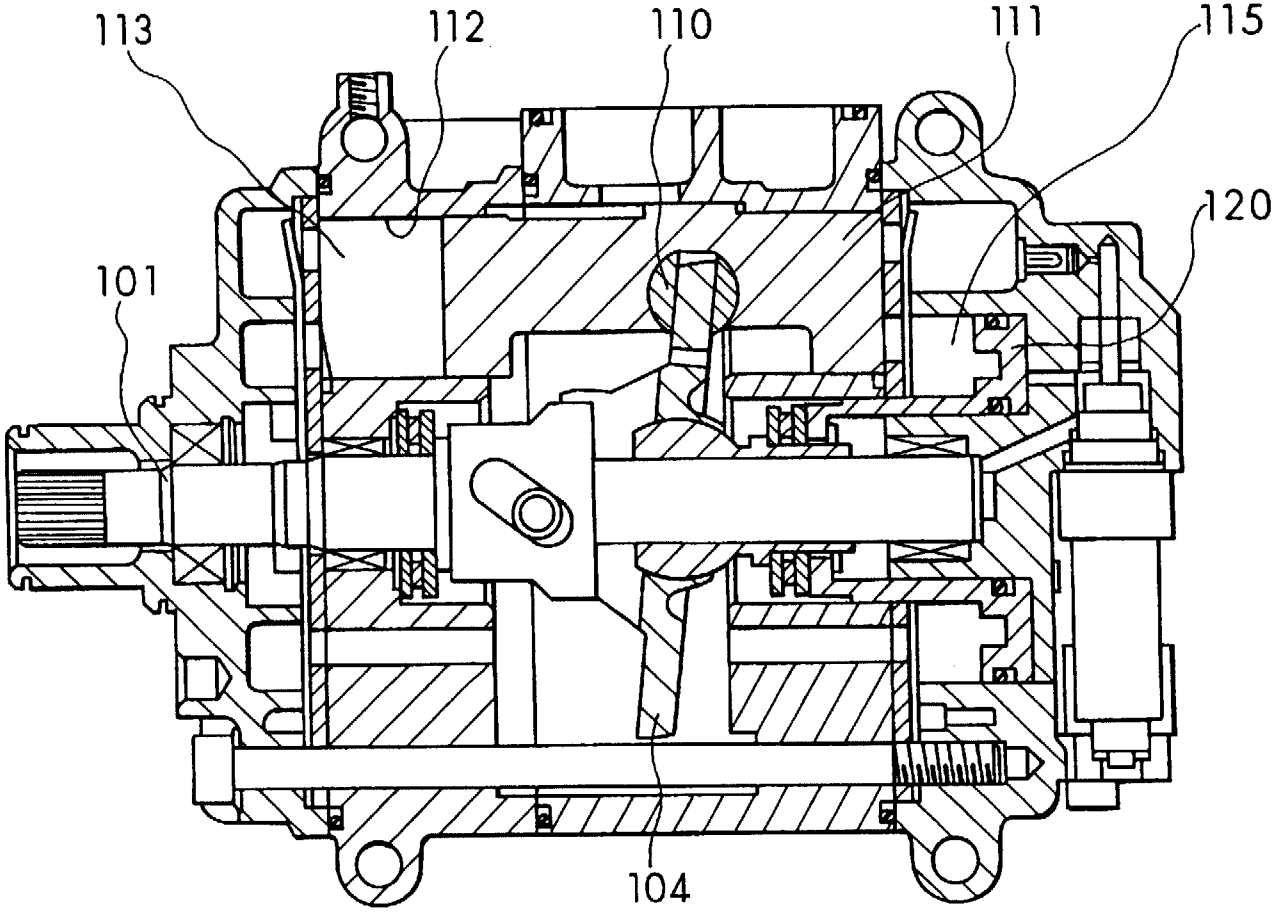
FIG. 15 is a sectional view of a variable-capacity compressor employed in the seventh embodiment during low capacity.

FIGS. 14 and 15 indicate an example of a compressor 1 of continuously variable capacity type; numeral 101 is a rotating shaft which receives drive force from an engine to rotate. This rotating shaft 101 is instructed freely and rotatably to a housing via bearings 102 and 103.

An inclined plate 104 is installed on the rotating shaft 101 so that the tilt angle thereof can be varied. That is to say, the rotational center location of the inclined plate 104 is freely rotatable at a spherical support portion 105, and moreover is mated with a two-faced width portion 107 within a groove 106 formed on the inclined plate 104 side, so that rotation of the rotating shaft 101 is conveyed to the inclined plate 104.

Additionally, a pin 108 is fixed to the inclined plate 104 via the groove portion 106, so that the tilt angle of the inclined plate 104 is varied by movement of this pin 108 within a long groove 109 formed in the two-faced width portion 107 of the rotating shaft 101.

The inclined plate 104 is interconnected with a piston via a shoe 110, and the piston 111 receives rocking motion of the inclined plate 104 to slide reciprocatingly within a cylinder 112. In an intake stroke in which the volume of an operating chamber 113 expands in accompaniment to the reciprocating sliding of this piston 111, an intake valve 114 opens and refrigerant is taken into the operating chamber 113 side from an intake chamber 115. Meanwhile, in a discharge stroke in which the volume of the operating chamber 113 decreases in accompaniment to the reciprocating sliding of this piston 111, refrigerant is discharge through a discharge valve 116 to a discharge chamber 117. Moreover, the intake chamber 115 is communicated with an intake port 118 via an intake passage within the compressor 1 so that low-temperature, low-pressure refrigerant taken in from the evaporator 6 of the refrigeration cycle is supplied. Meanwhile, the discharge chamber 117 is communicated with a discharge port 119 through discharge passage within the compressor 1 so that refrigerant is discharged to the condenser 3 side of the refrigeration cycle from the discharge port 119 thereof.

The discharge volume of this compressor 1 is continuously varied by means of variable control of the reciprocating stroke amount of the piston 111. Variation of the reciprocating stroke amount of this piston 111 is performed by means of varying the tilt angle of the inclined plate 104. Variation of this tilt angle is performed by means of interlocking and varying the rotational center location and tilt angle of the inclined plate 104 in a state wherein this of constantly uniform top dead center indicated in the center right-hand side of FIG. 14.

According to the present embodiment, the foregoing control is performed by means of employing a spool 120 to cause the spherical support portion 105 to be displaced along the rotating shaft 101 in the lateral direction of the center of the drawing. The locational displacement of the spool 120 is performed by means of regulating pressure within a control-pressure chamber 121 caused to be formed on a rear surface thereof. That is to say, one side of the spool 120 becomes the intake chamber 115 to which intake pressure is constantly applied. In contrast to this, the control chamber 121 is supplied with pressure which has been adjusted by means of a control valve 122, and differential pressure of pressure within this control-pressure chamber 121 and pressure within the intake chamber 115 is applied to the spool 120. Accordingly, the location of the tilt angle is controlled at a location balanced by pressure applied to this spool 120 and the compression reaction force with the piston 111.

Furthermore, the control valve 122 adjusts discharge pressure supplied from the discharge chamber 117 through a high-pressure induction passage 123 and low pressure (intake pressure) supplied from a low-pressure induction passage 124, supplying uniform pressure from a control-pressure passage 125 to the control-pressure chamber 121, and so according to the present embodiment an electrical-control type which switches the foregoing two passages 123 and 124 by means of electrical signals is utilized.

It is also possible to employ a pressure-responsive member such as a diaphragm as the control valve 122 to utilize a structure to regulation control pressure by means of a purely mechanical mechanism.

FIG. 14 indicates a state wherein a predetermined pressure has been supplied to the control-pressure chamber 121 and the spool 120 has been shifted to the left-hand side of the center of drawing by a predetermined amount.

FIG. 15 indicates a state wherein the discharge capacity of the compressor 1 has been reduced further from the state indicated in this FIG. 14. In this state, intake pressure is supplied to the control-pressure chamber 121. As a result of this, the spool 120 is displaced by the maximum amount to the right-hand side of the center of the drawing in accompaniment with compression reaction force and the like of the piston 111. As a result of this, the rotational center location of the inclined plate 104 is also displaced to the right-hand side of the center of the drawing, and the tilt angle of the inclined plate 104 is also displaced in a direction approaching a right angle with respect to rotating shaft 101.

As is clear from FIG. 15, in this state the amount of rocking of the inclined plate 104 is small as well, and consequently the reciprocating stroke of the piston 111 is at a minimum.

In a cycle employing a variable-capacity compressor 1, generally, during low load (i.e., when high pressure is low), the capacity of the compressor 1 becomes small, return of lubrication oil to the compressor 1 deteriorates, and the problem of insufficient lubrication of the compressor 1 is susceptible to occurrence.

Accordingly, special modifications were priorly made to the control characteristics and so on of the expansion valve 5, so that refrigerant was returned to the compressor 1 during low load, thereby eliminating insufficient lubrication of the compressor 1, but according to the present embodiment, during low load when low-capacity running of the variable-capacity compressor 1 is performed, liquid-phase refrigerant can be caused to be bypassed to the gas-phase refrigerant discharge passage 9 by means of regulating the aperture ratio of the two aperture resistances 11 and 12 as described above, and so the effect of easily being able to return liquid-phase refrigerant containing lubrication oil to the compressor 1 can also be demonstrated.

Consequently, an expansion valve 5 of standard type can be utilized in common without the need to utilize a special expansion valve 5.

What is claimed is:

1. A temperature-opening type expansion valve comprising;

a body case;

a liquid-phase refrigerant influx passage provided on said body case into which flows liquid-phase refrigerant condensed by a condenser;

a restricting passage provided on a downstream side of said liquid-phase refrigerant influx passage within said body case to reduce pressure of liquid-phase refrigerant;

a valve provided within said body case to regulate a degree of opening of said restricting passage;

a gas-liquid separation means provided within said body case to separate gas-liquid two-phase refrigerant pressure-reduced by said restricting passage into liquid-phase refrigerant and gas-phase refrigerant;

a liquid-phase discharge passage provided in said body case so as to be communicated with an inlet side of an evaporator, to discharge liquid-phase refrigerant separated by the said gas-liquid separation means to an inlet side of the evaporator;

a gas-phase discharge passage provided in said body case to discharge gas-phase refrigerant separated by the said gas-liquid separation means to an evaporator outlet side;

a gas-phase refrigerant passage provided in said body case so as to cause gas-phase refrigerant evaporated by said evaporator to flow in and be united with gas-phase refrigerant from said gas-phase refrigerant discharge passage during a process thereof, and to cause gas-phase refrigerant after said union to flow into an intake side of said compressor;

a temperature-sensing means disposed in a location in said gas-phase refrigerant passage which is upstream of a union location of gas-phase refrigerant evaporated by said evaporator and gas-phase refrigerant from said gas-phase refrigerant discharge passage, to sense temperature of gas-phase refrigerant evaporated by said evaporator; and a valve operating means to regulate a degree of opening of said valve in correspondence to said gas-phase refrigerant temperature sensed by means of said temperature-sensing means.

2. An expansion valve according to claim 1, wherein a passage is defined in said body case such that gas-phase refrigerant from the evaporator may flow thereinto, said passage communicating with said gas-phase discharge passage.

3. Art expansion valve according to claim 1, wherein said gas-liquid separation means comprises a centrifugal type separator.

4. Art expansion valve according to claim 3, wherein said gas phase refrigerant passage is defined in said separator.

5. An expansion valve according to claim 4, wherein said gas phase refrigerant passage is defined by an introduction pipe.

6. An expansion valve according to claim 1, wherein said body case is constructed and arranged to be coupled to a condenser and an evaporator.

* * * * *